US008167675B2

(12) United States Patent
Yukinobu et al.

(10) Patent No.: US 8,167,675 B2
(45) Date of Patent: May 1, 2012

(54) DISPERSION-TYPE ELECTROLUMINESCENT ELEMENT AND METHOD FOR MANUFACTURING THE SAME

(75) Inventors: Masaya Yukinobu, Ichikawa (JP); Yuki Murayama, Ichikawa (JP); Yasuo Tsukui, Nasukarasuyama (JP)

(73) Assignee: Sumitomo Metal Mining Co., Ltd (JP)

( * ) Notice: Subject to any disclaimer, the term of this patent is extended or adjusted under 35 U.S.C. 154(b) by 606 days.

(21) Appl. No.: 12/308,839

(22) PCT Filed: Jun. 26, 2006

(86) PCT No.: PCT/JP2006/312737

§ 371 (c)(1),
(2), (4) Date: Dec. 26, 2008

(87) PCT Pub. No.: WO2008/001417

PCT Pub. Date: Jan. 3, 2008

(65) Prior Publication Data

US 2009/0184637 A1 Jul. 23, 2009

(51) Int. Cl.
*H01J 1/62* (2006.01)
*H01J 63/04* (2006.01)
*H01J 9/00* (2006.01)

(52) U.S. Cl. ..... 445/24; 445/1; 445/25; 445/58; 313/483; 313/509; 313/500; 313/501; 313/502; 313/503; 313/504; 313/505; 313/506

(58) Field of Classification Search ..... None
See application file for complete search history.

(56) References Cited

U.S. PATENT DOCUMENTS

| | | | | |
|---|---|---|---|---|
| 6,373,008 | B1 * | 4/2002 | Saito et al. | 200/310 |
| 6,611,097 | B1 | 8/2003 | Hanahara et al. | |
| 2005/0208230 | A1 | 9/2005 | Ikeda | |

FOREIGN PATENT DOCUMENTS

| | | |
|---|---|---|
| JP | 4-237909 | 8/1992 |
| JP | 5-36314 | 2/1993 |
| JP | 8-255521 | 10/1996 |
| JP | 2001-35652 | 2/2001 |
| JP | 2001-273831 | 10/2001 |
| JP | 2002-50469 | 2/2002 |
| JP | 2002-232537 | 8/2002 |
| JP | 2005-301241 | 10/2005 |

* cited by examiner

*Primary Examiner* — Natalie Walford
(74) *Attorney, Agent, or Firm* — Gerald E. Hespos; Michael J. Porco

(57) ABSTRACT

A dispersion-type EL element is a dispersion-type electroluminescent element with at least a transparent coating layer, a transparent conductive layer, a phosphor layer, a dielectric layer and a rear electrode layer sequentially formed on a base film surface. The transparent coating layer can be peeled off the surface of the base film. The transparent conductive layer is formed by applying a coating liquid composed mainly of conductive oxide particles and a binder on a surface of the transparent coating layer, applying compression processing to the applied layer and then curing the compressed layer.

12 Claims, 2 Drawing Sheets

DISPERSION-TYPE ELECTROLUMINESCENT ELEMENT AND METHOD FOR MANUFACTURING THE SAME

BACKGROUND OF THE INVENTION

1. Field of the Invention

The present invention relates to a dispersion-type electroluminescent element obtained using a film with transparent conductive layer on which a transparent conductive layer mainly composed of conductive oxide particles and a binder is formed and a method for manufacturing the same and particularly to a dispersion-type electroluminescent element applied as a light-emitting element incorporated in a key input component of various devices such as a cellular phone and the like and a method for manufacturing the same.

2. Description of the Related Art

The dispersion-type electroluminescent element (hereinafter abbreviated as "dispersion-type EL element" in some cases) is a light-emitting element by alternating current driving and is used for a backlight and the like of liquid crystal display in a cellular phone, a remote controller and the like and an application to a light emitting element incorporated in a key input component (key pad) of various devices has been recently tried as a new usage.

Such a device includes, for example, a portable information terminal and the like such as a cellular phone, a remote controller, a PDA (Personal Digital Assistance), a laptop PC and the like, and the light emitting element is used with the purpose of facilitating a key input operation in a dark place such as during a night.

ds the light emitting element of the key input component (key pad), a light emitting diode (LED) has been applied, but since there are problems such that the LED is a point light source, its brightness on a key pad portion is non-uniform and its appearance is poor, white/blue luminescent colors are generally preferred but those colors take a high cost in the LED, power consumption is larger than the dispersion-type EL element and the like, a trend to apply the dispersion-type EL element instead of the LED has become remarkable.

As a method for manufacturing such a dispersion-type EL element, the following methods are widely employed in general. That is, it is a method of sequentially forming a phosphor layer, a dielectric layer, and a rear electrode layer by screen printing and the like on a plastic film (hereinafter abbreviated as "sputtered ITO film") on which a transparent conductive layer of an indium tin oxide (hereinafter abbreviated as "ITO") is formed, using a physical film forming method such as sputtering, ion-plating and the like.

Here, as a paste used for application (printing) formation of each layer of the phosphor layer, dielectric layer, and the rear electrode layer, phosphor particles, dielectric particles and conductive particles are dispersed, respectively, in a solvent containing a binder, and a commercial paste, for example, may be used.

The sputtered ITO film is formed so that a ITO single layer, which is an inorganic component, is formed on a transparent plastic film of polyethyleneterephthalate (PET), polyethylenenaphthalate (PEN) and the like by the above physical film forming method to have a thickness of approximately 20 to 50 nm, and a low resistance of approximately a surface resistivity: 100 to 300Ω/□ (ohm per square) is obtained.

However, since the ITO layer is an inorganic thin film and extremely fragile, a micro crack (split) can occur in the film, and in order to prevent that, a plastic film to be a base material needs to be provide sufficient strength and rigidity and its thickness is set at least at 50 μm or more, or usually 75 μm or more.

A PET film is now widely used for the base film of the above sputtered ITO film, but if its thickness is less than 50 μm, flexibility of the film is too high and a crack can easily occur in the ITO layer during handling, which extremely damages conductivity of the film. Thus, a thin sputtered ITO film with the thickness of approximately 25 μm, for example, has not been in a practical use. In the case of a soft base film made of urethane and the like, even if its film thickness is 75 μm or more, it can easily have a crack when the sputtered ITO layer is formed and has not been in a practical use.

Characteristics required when the dispersion-type EL element is applied to the keypad include, as described in Patent Document 1, for example, the above-mentioned uniformity in brightness and low power consumption and particularly, excellence in click feeling when the key pad is operated are important.

In order not to impair the click feeling when the dispersion-type EL element is incorporated in the key pad, the flexibility of the dispersion-type EL element itself needs to be sufficiently improved, that is, the thickness of the element is made as thin as possible or a flexible base film needs to be used.

However, if the dispersion-type EL element is manufactured using the above-mentioned sputtered ITO film, it is necessary to have a thickness of at least 50 μm or more for the base film in order to prevent a crack in the ITO layer so as to improve rigidity of the film, and the flexible base film can not be used. Thus, there is a problem that the click feeling of the key operation is not sufficiently favorable, if the element is applied to the key pad.

As another problem different from the above, Patent Document 2, for example, points out breakage/failure of an LCD (liquid crystal) component and the like caused by static electricity generated at a key input of a cellular phone. Thus, a similar problem might also occur in a key input component of the dispersion-type EL element, and as a measure against it, there is a method in which a transparent conductive layer is formed on an outer surface of the dispersion-type EL element, for example so as to have the static electricity escape, but since the base film for the key pad has high flexibility as mentioned above, it can not be applied to the conventional sputtered ITO film. Also, it is not easy to form an inexpensive transparent conductive film satisfying durability (hitting durability), transparency, conductivity required for the key pad on the outer surface of the dispersion-type EL element.

Patent Document 1: Japanese patent Laid-Open No. 2001-273831. with

Patent Document 2: Japanese patent Laid-Open No. 2002-232537.

SUMMARY OF THE INVENTION

The present invention was made in view of the above conventional circumstances and has an object to provide a dispersion-type EL element more excellent in flexibility than the dispersion-type EL element using a conventional sputtered ITO film or specifically to provide a dispersion-type EL element formed on a thin or flexible transparent plastic film and a method for manufacturing the same.

In order to achieve the above object, the inventors have conducted various examinations and found out that in the dispersion-type electroluminescent elements made of at least a transparent coating layer, a transparent conductive layer, a phosphor layer, a dielectric layer, and a rear electrode layer sequentially formed on a surface of a base film, the transparent coating layer is made capable of being peeled off the base film, and by using a method of applying and forming the transparent conducive layer on the base film not by the conventional physical film forming method but by using a transparent conductive layer forming coating liquid, since the transparent conductive layer is mainly composed of conductive oxide particles and a binder matrix, easy occurrence of a crack in the transparent conducive layer during handling of the transparent conductive film, which extremely impairs its conductivity, can be suppressed, and by compression processing of the applied layer obtained by application of the transparent conductive layer forming coating liquid, a packing density of the conductive particles in the transparent conductive layer is raised, scattering of light is lowered, and optical characteristics of the film is improved. In addition, the conductivity is drastically improved, the dispersion-type EL element more excellent in conductivity and flexibility than the dispersion-type EL element using the conventional sputtered ITO film can be provided inexpensively, and in the case of application of the dispersion-type EL element to the key pad in the cellular phone, favorable click feeling of a key operation can be obtained without any special structure or devising on the key pad, which leads to the present invention.

That is, the dispersion-type electroluminescent element according to the present invention is a dispersion-type electroluminescent element made of at least a transparent coating layer, a transparent conductive layer, a phosphor layer, a dielectric layer, and a rear electrode layer sequentially formed on a base film surface, characterized in that the transparent coating layer is formed on the base film surface using a transparent coating layer forming coating liquid mainly composed of a transparent resin and can be peeled off the base film surface, and the transparent conductive layer is obtained by applying compression processing to an applied layer formed by applying a transparent conductive layer forming coating liquid mainly composed of conductive oxide particles and a binder on the transparent coating layer surface and then, curing the compressed layer.

Also, in another dispersion-type electroluminescent element according to the present invention is characterized in that a second transparent conductive layer is further formed between the transparent base film and the transparent coating layer, the second transparent conductive layer is formed by applying the transparent conductive layer forming coating liquid mainly composed of the conductive oxide particles and the binder on the base film surface and curing or by applying compression processing to a second applied layer formed by applying the transparent conductive layer forming coating liquid on the base film surface and then, curing the compressed layer.

Next, another dispersion-type electroluminescent element according to the present invention is characterized in that a thickness of the transparent coating layer is 50 μm or less, the transparent coating layer is a coating layer reinforced by a fiber and/or flake particles formed on the base film surface using an a transparent coating layer forming coating liquid mainly composed of a transparent resin and a visible-light transmissive fiber and/or flake particles, and the conductive oxide particles contain at least any one or more of indium oxide, tin oxide, zinc oxide as main components, the conductive oxide particle with the indium oxide as the main component is an indium tin oxide particle, the binder is cross-linkable, the transparent conductive layer and the second transparent conductive layer have resistance against organic solvent, the compression processing is conducted by rolling processing of metal rolls, the base film is peeled off and removed at an interface with the transparent coating layer or the second transparent conductive layer, the above-mentioned dispersion-type electroluminescent element is applied as a light emitting element incorporated in a key input component of a device, and the device is a cellular phone, a remote controller, a portable information terminal.

Moreover, the method for manufacturing the dispersion-type electroluminescent element according to the present invention is a method for manufacturing a dispersion-type electroluminescent element in which at least a transparent coating layer, a transparent conductive layer, a phosphor layer, a dielectric layer, and a rear electrode layer are sequentially formed on a base film surface, characterized in that an applied layer is formed using a transparent conductive layer forming coating liquid mainly composed of the conductive oxide particles and the binder on the transparent coating layer surface formed using an a transparent coating layer forming coating liquid mainly composed of a transparent resin and then, compression processing is conducted for the base film on which the transparent coating layer and the applied layer are formed and then, the compressed layer is cured so as to form the transparent conductive layer.

Next, a method for manufacturing another dispersion-type electroluminescent element according to the present invention is a method for manufacturing a dispersion-type electroluminescent element in which at least a transparent coating layer, a transparent conductive layer, a phosphor layer, a dielectric layer, and a rear electrode layer are sequentially formed on a base film surface, characterized in that a second transparent conductive layer is formed by applying and curing using a transparent conductive layer forming coating liquid mainly composed of the conductive oxide particles and the binder on the base film surface or by applying the compression processing to the second applied layer formed by application and then, curing the compressed layer, the transparent coating layer is applied and formed by using the a transparent coating layer forming coating liquid mainly composed of a transparent resin on a surface of the second transparent conductive layer and further, an applied layer is formed by using a transparent conductive layer forming coating liquid mainly composed of the conductive oxide particles and the binder on a surface of the transparent coating layer, and then, a transparent conductive layer is formed by applying the compression processing to the base film, the second transparent conductive layer, the transparent coating layer, and the applied layer and then, curing the applied layer.

Also, a method for manufacturing another dispersion-type electroluminescent element according to the present invention is characterized in that the a transparent coating layer forming coating liquid further contains visible-light transmissive fiber and/or flake particles, the base film is further peeled off and removed from the interface with the transparent coating layer or the second transparent conductive layer after the above-mentioned manufacturing process of the dispersion-type electroluminescent element, the compression processing is carried out by rolling processing of metal rolls, the rolling processing is carried out with a linear pressure: 29.4 to 784 N/mm (30 to 800 kgf/cm), and the rolling processing is carried out with a linear pressure: 98 to 490 N/mm (100 to 500 kgf/cm).

Effect of the Invention

According to the present invention, by using a method in which dispersion-type electroluminescent element having at least a base film, and a transparent coating layer, a transparent conductive layer, a phosphor layer, a dielectric layer, and a rear electrode layer sequentially formed on the base film, in which the transparent coating layer can be peeled off the base film, the transparent conductive layer is applied and formed on the base film not using a conventional physical film forming method but using a transparent conductive layer forming coating liquid, since the transparent conductive layer is mainly composed of conductive oxide particles and a binder matrix, easy occurrence of a crack in the transparent conductive layer during handling of a transparent conductive film, which remarkably impairs its conductivity, is suppressed, and moreover, by applying compression processing to an applied layer obtained by the application of the transparent conductive layer forming coating liquid, optical characteristics of a film are improved by raising a packing density of the conductive particles in the transparent conductive layer and lowering scattering of light and moreover, the conductivity is drastically improved so that a dispersion-type EL element more excellent in conductivity and flexibility than the dispersion-type EL element using a conventional sputtered ITO film can be provided inexpensively. Also, if the above dispersion-type EL element is applied to a key pad of a cellular phone and the like, a favorable click feeling of a key operation can be obtained without any special structure or devising on the key pad, which is industrially advantageous.

DESCRIPTION OF THE REFERENCE NUMERALS

Figure 1:
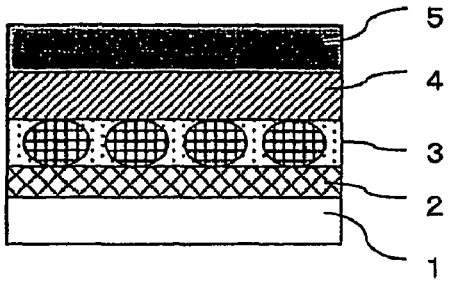
FIG. 1 is a sectional view illustrating a basic structure of a conventional dispersion-type EL element.

1 transparent plastic film
2 transparent conductive layer
3 phosphor layer
4 dielectric layer
5 rear electrode layer
6 collecting electrode
7 insulating protective layer
8 base film
9 transparent coating layer
10 second transparent conductive layer

DETAILED DESCRIPTION OF THE PREFERRED EMBODIMENTS

Figure 2:
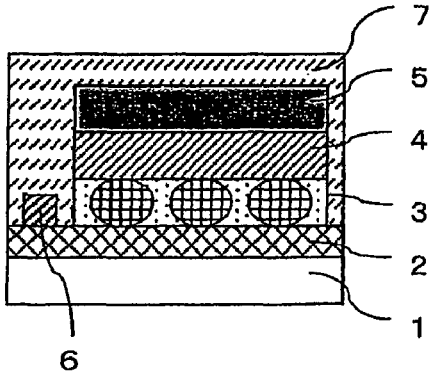
FIG. 2 is a sectional view illustrating another structure of a conventional dispersion-type EL element.

The conventional dispersion-type electroluminescent element has at least a transparent conductive layer 2, a phosphor layer 3, a dielectric layer 4, and a rear electrode layer 5 sequentially formed on a transparent plastic film 1 as shown in FIG. 1, and in application to an actual device, as shown in FIG. 2, a collecting electrode 6 such as silver and the like and an insulating protective layer 7 are further formed for use in general.

Figure 3:
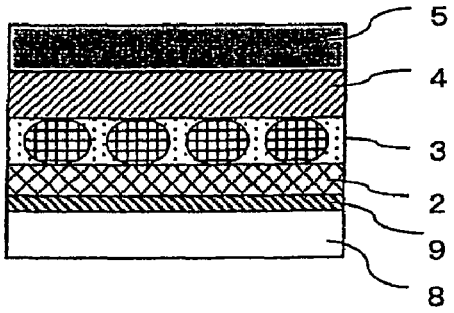
FIG. 3 is a sectional view illustrating a dispersion-type EL element with a basic structure according to the present invention.
Figure 4:
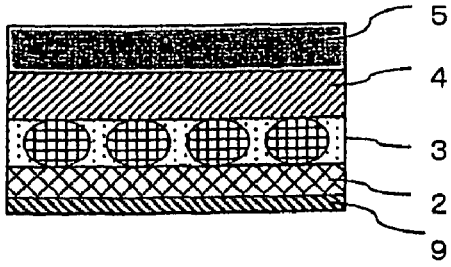
FIG. 4 is a sectional view illustrating a dispersion-type EL element with another structure according to the present invention.

On the other hand, the dispersion-type electroluminescent element according to the present invention has at least a transparent coating layer 9, the transparent conductive layer 2, the phosphor layer 3, the dielectric layer 4, and the rear electrode layer 5 sequentially formed on a base film 8 as shown in FIG. 3. In an application to an actual device, as shown in FIG. 4, it is used in a state where the base film is peeled off and removed at an interface with the transparent coating layer (though not shown in FIG. 4, the collecting electrode such as silver and the like and the insulating protective layer are further formed for use in general similarly to FIG. 2).

The base film used in the present invention preferably has its thickness of 50 μm or more.

If the thickness of the base film is less than 50 μm, rigidity of the film is lowered, and problems can easily occur in handling of the above-mentioned manufacturing process of the dispersion-type EL element, curling of a base material, printability on the phosphor layer, the dielectric layer, the rear electrode layer and the like. On the contrary, if the thickness is 150 μm or more, the base film becomes hard and difficult to be handled and is not preferable in view of cost.

Thus, considering the both, it is optimal that the thickness of the base film is 75 μm or more and 125 μm or less.

The base film does not require transparency but only needs to have peel property from the transparent coating layer, and the material is not particularly limited but various plastics can be used. Specifically, plastics such as polycarbonate (PC), polyethersulphone (PES), polyethyleneterephthalate (PET), polyethylenenaphthalate (PEN), nylon, polyethersulphone (PES), polyimide (PI) and the like can be used. Among them, use of a PET film is preferable from the viewpoint of its excellence in price, strength, and flexibility and the like.

Here, roles of the base film include a function to ease handling of the dispersion-type EL element of the present invention in the manufacturing process, a function to prevent curling of the base material in a laminating process of the phosphor layer, the dielectric layer, the rear electrode layer and the like, a function of protection during transportation and handling of the dispersion-type EL element, a function to uniformly apply printing on the transparent conductive layer, the phosphor layer, the dielectric layer, the rear electrode layer and the like (in the screen printing in general, using a suction stage with a large number of small-diameter holes, a pressure of the hole portion is reduced so as to fix the film, but if the film as a base material is thin, the film on the hole portion is deformed and hollowed due to pressure reduction, which causes a trace of this hollow on the screen-printed film) and the like.

Since the transparent coating layer used in the present invention is applied and formed on the base film using the transparent coating layer forming coating liquid mainly composed of a transparent resin, its thickness can be freely set but the thickness is preferably 1 μm or more and 50 μm or less. If the thickness of the transparent coating layer exceeds 50 μm, its rigidity is raised, and if it is incorporated in the above-mentioned key pad as the dispersion-type EL element, a favorable click feeling can not be obtained easily.

Also, if the thickness of the transparent coating layer is preferably 25 μm or less, more preferably 15 μm or less, or further preferably 5 μm or less, a further favorable click feeling can be obtained, and since the total thickness of the dispersion-type EL element can be made as thin as 100 μm or less, for example, it is also preferable in a point that freedom in designing the device is improved.

Since the transparent coating layer comes to the outermost surface of the dispersion-type EL element in the end, it is necessary to electrically insulate the transparent conductive layer, but if its thickness is less than 1 μm, there is a possibility that the insulating can not be sufficient, which is not favorable.

Moreover, the material of the transparent coating layer (transparent resin) is not particularly limited as long as it has peel property from the base film and it is possible to form the transparent conductive layer on the layer and various resins can be used. Specifically, resins including urethane, epoxy, polyester, fluorine resin and the like can be used. Among them, urethane and fluorine resins are preferable from the viewpoints of excellence in price, transparency, strength, flexibility and the like.

Also, it is possible to reinforce the transparent coating layer with a fiber and/or flake particles by having the transparent coating layer forming coating liquid further contain visible-light transmissive fiber and/or flake particles. The transparent coating layer reinforced as above has a characteristic that the strength can be maintained sufficiently high even if its thickness is reduced.

As the visible-light transmissive fiber (including those in a needle state and a rod state and a whisker) used in reinforcement of the transparent coating layer, various inorganic fibers and organic fibers (plastic fiber) can be applied as long as it is visible-light transmissive and a thickness of the fiber is approximately 2 to 3 μm or less. For example, the inorganic fibers include silica fiber, titania fiber, alumina fiber, potassium titanate fiber, aluminum borate fiber and the like, and the organic fibers include polyester fiber, nylon fiber, aramid fiber and the like, but not limited to them.

As the visible-light transmissive flake particles (including those in a plate state) used for reinforcement of the transparent coating layer, various inorganic and organic (plastic) flake particles can be applied as long as it is visible-light transmissive and a thickness of the flake particle is approximately 2 to 3 μm or less. For example, the inorganic flake particles include flake particles of silica, titania, alumina and the like and a clay such as calcined kaolin and the like.

The above fibers and flake particles have an action to reinforce the transparent coating layer in a state dispersed in a transparent resin (binder matrix), but since it is necessary to improve adhesive strength between the fiber or the flake particles and the transparent resin for strength improvement, adhesion-promoting treatment (coupling agent treatment, plasma treatment and the like) is preferably applied on the surface of the fiber and the flake particles as necessary. As a coupling agent in the coupling agent treatment, various coupling agents such as silane coupling agent and titanate coupling agent and the like can be applied, for example. The silane coupling agents include γ-glycidoxypropyltrimethoxysilane, γ-methacryloxy propyltrimethoxysilane, vinyltrimethoxysilane and the like, but it may be selected as appropriate according to the type of the transparent resin in use and not limited to them.

In this way, according to the present invention, the thickness of the transparent coating layer can be set extremely thin, and if a material is selected as appropriate, favorable flexibility can be given according to usage.

Figure 5:
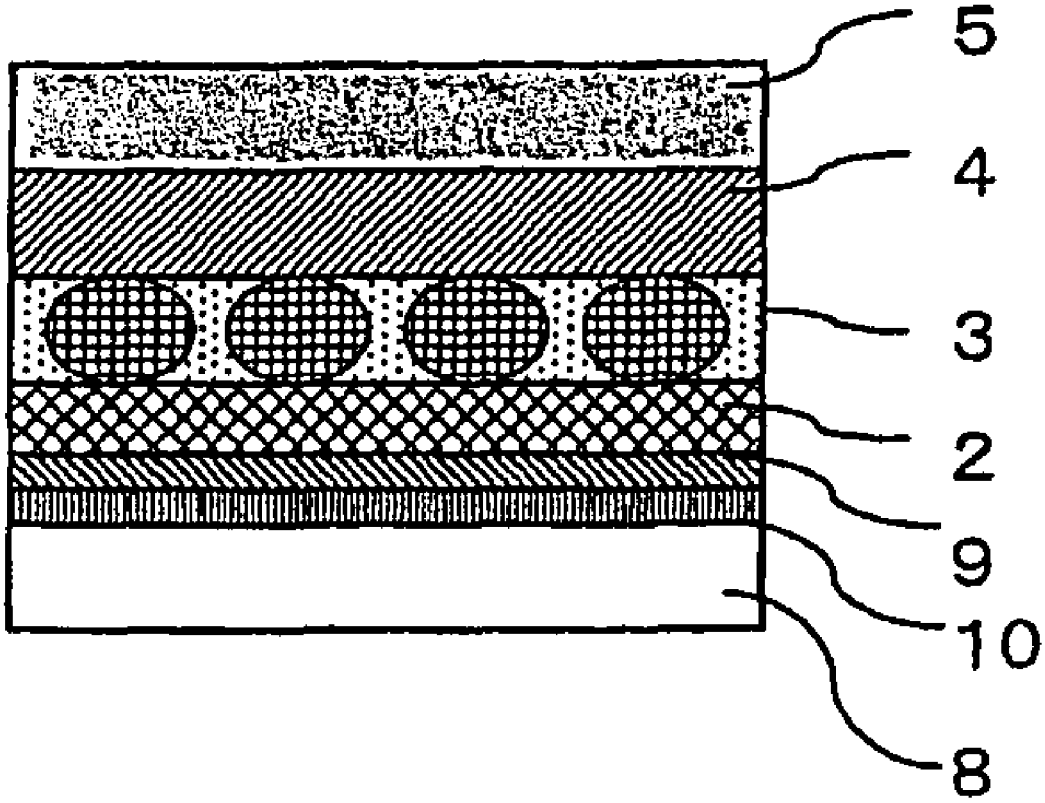
FIG. 5 is a sectional view illustrating a dispersion-type EL element with still another structure according to the present invention.

In the dispersion-type EL element according to the present invention, a second transparent conductive layer 10 may be further formed between the base film 8 and the transparent coating layer 9 as shown in FIG. 5 (in application to an actual device, it is used in a state where the base film is peeled off and removed at the interface with the second transparent conductive layer 10).

The second transparent conductive layer has a purpose of preventing various adverse effects caused by static electricity and its resistance value may be much higher than the resistance value of the above-mentioned transparent conductive layer applied as an electrode of the dispersion-type EL element, and the value is preferably approximately $1M(1\times10^6)$ Ω/□ or less, for example.

The second transparent conductive layer is formed by applying and curing on the base film using the transparent conductive layer forming coating liquid in which the conductive oxide particles are dispersed in a solvent containing a binder component or by applying the transparent conductive layer forming coating liquid on the base film so as to form a second applied layer and then, compression processing applied to the second applied layer and then the compressed layer is cured, but from the viewpoint of preventing a drop of brightness of the dispersion-type EL element as much as possible, it preferably has a high transmittance, and thus, the film thickness is preferably 3 μm or less, or more preferably 1 μm or less.

A material of the binder used in the second transparent conductive layer is not particularly limited as long as it has peel property from the base film and a transparent coating layer can be formed on it, and various resins may be used. Specifically, resins such as urethane, epoxy, polyester, fluorine resins and the like may be used. Among them, urethane resins are preferable from the viewpoint of excellence in price, transparency, strength and flexibility and the like.

The formation of the transparent conductive layer mainly composed of the conductive oxide particles and the binder matrix on the transparent coating layer can be obtained by applying and drying on the surface of the transparent coating layer using the transparent conductive layer forming coating liquid in which the conductive oxide particles are dispersed in the solvent containing the binder component, and then, by applying compression processing to it together with the base film on which the transparent coating layer is formed and then, by curing the binder component.

The film (applied layer) before the compression processing obtained by applying and drying the transparent conductive layer forming coating liquid is in a state where a large number of micro voids are formed between the conductive particles and the binder matrix. The voids are generated because a mixed amount of the binder component is small in the transparent conductive layer forming coating liquid of the present invention (in the case of the conductive particles/binder component=90/10, for example), and close-packing of the conductive particles is difficult only by applying and drying the transparent conductive layer forming coating liquid, and considerable voids are formed between the conductive particles and they can not be completely filled by the binder component.

Here, as the compression processing, the base film having the transparent coating layer on which the transparent conductive layer forming coating liquid is applied and dried may be rolled by steel rolls, for example. In the present invention, the dispersion-type EL element is finally obtained with a structure having a rolling-processed transparent conductive layer on an extremely thin transparent coating layer, but in the rolling processing process, since the rolling processing is carried out together with thick base film, a relatively high rolling pressure can be applied. A linear pressure of the rolling pressure of the steel rolls in this case is preferably 29.4 to 784 N/mm (30 to 800 kgf/cm), more preferably 98 to 490 N/mm (100 to 500 kgf/cm), and further preferably 196 to 294 N/mm (200 to 300 kgf/cm). If the linear pressure is less than 29.4 N/mm (30 kgf/cm), an effect of improving the resistance value of the transparent conductive layer by the rolling processing is not sufficient, while if the linear pressure exceeds 784 N/mm (800 kgf/cm), a rolling facility would become large and the base film and the transparent coating layer might be distorted. Considering a price of the rolling facility and a balance among the characteristics of the transparent conductive layer by the rolling processing (transmittance, haze, resistance value), the value is preferably set as appropriate in a range of 98 to 490 N/mm (100 to 500 kgf/cm).

The rolling pressure ($N/mm^2$) in the rolling processing of the steel rolls is a value obtained by dividing a linear pressure by a nip width (width compressed by the steel rolls). The nip width is approximately 0.7 to 2 mm for a diameter of approximately 150 mm, though it depends on a diameter and a linear pressure of the steel rolls.

By the rolling processing, the packing density of the conductive particles in the transparent conductive layer can be improved to approximately a low value of 45 vol % or less to as high as 50 to 80 vol % (preferably 55 to 80%), for example, though it depends on the linear pressure as compared with the case without carrying out the rolling processing. The packing density exceeding 80 vol % seems to be difficult to be achieved, considering presence of the binder component contained in the transparent conductive layer forming coating liquid and a physical packing structure of the conductive particles.

By carrying out such rolling processing, since the voids present in the film are shrunk and lost and the packing density of the conductive particles in the transparent conductive layer is raised, not only that the scattering of light is lowered and the optical characteristics of the film are improved but that the conductivity can be drastically raised.

The transparent coating layer may be applied with adhesion-promoting treatment, or specifically, plasma treatment, corona discharge treatment, short-wavelength ultraviolet irradiation treatment and the like in advance in order to improve adhesion with the transparent conductive layer.

The conductive oxide particles used in the transparent conductive layer forming coating liquid are conductive oxide particles mainly composed of any one or more of indium oxide, tin oxide and zinc oxide and include, for example, indium tin oxide (ITO) particle, indium zinc oxide (IZO) particle, indium-tungsten oxide (IWO) particle, indium-titanium oxide (ITiO) particle, indium zirconium oxide particle, tin antimony oxide (ATO) particle, fluorine tin oxide (FTO) particle, aluminum zinc oxide (AZO) particle, gallium zinc oxide (GZO) particle and the like but not limited to them as long as transparency and conductivity are provided.

However, among them, ITO has the highest characteristics in a point that it has both a high visible-light transmittance and an excellent conductivity and it is preferable.

An average particle size of the conductive oxide particle is preferably 1 to 500 nm, and more preferably 5 to 100 nm. If the average particle size is less than 1 nm, manufacture of the transparent conductive layer forming coating liquid is difficult and a resistance value of the obtained transparent conductive layer is high. On the other hand, if the size exceeds 500 nm, the conductive oxide particles easily sediments in the transparent conductive layer forming coating liquid and its handling becomes difficult, and simultaneous achievement of both a high transmittance and a low resistance value in the transparent conductive layer becomes difficult.

The size of 5 to 100 nm is more preferable because it becomes possible to provide both the characteristics (transmittance, resistance value) of the transparent conductive layer and stability (sediment of the conductive particles) and the like of the transparent conductive layer forming coating liquid in a well-balanced manner.

The average particle size of the conductive oxide particles is indicated by a value observed by a transmission electron microscope (TEM).

The binder component of the transparent conductive layer forming coating liquid has a function to bind the conductive oxide particles together and to improve conductivity and strength of the film, a function to improve adhesion between the transparent coating layer and the transparent conductive layer, and a function to impart solvent resistance in order to prevent deterioration of the transparent conductive layer caused by an organic solvent contained in various printing pastes used for forming of the phosphor layer, dielectric layer, rear electrode layer and the like in a manufacturing process of the dispersion-type EL element. As the binder, an organic and/or an inorganic binder may be used and selected as appropriate, considering the transparent coating layer to which the transparent conductive layer forming coating liquid is applied and film forming conditions and the like of the transparent conductive layer so that the above roles are satisfied.

To the above organic binder, thermoplastic resins such as acrylic resin, polyester resin and the like may be applied, but the binder preferably has solvent resistance in general, and for that purpose, it should be a cross-linkable resin, and it can be selected from thermosetting resin, cold-setting resin, ultraviolet-curable resin, electron-beam curable resin and the like. For example, the thermosetting resins include epoxy resin, fluorine resin and the like, the cold-setting resins include two-component epoxy resin, urethane resin and the like, the ultraviolet-curable resins include resins containing various oligomers, monomers, and photoinitiator and the like, and the electron-beam curable resins include resins containing various oligomers and monomers and the like but not limited to these resins.

The inorganic binders include binders mainly composed of silica sol, alumina sol, zirconia sol, titania sol and the like. For example, as the silica sol, a polymer obtained by adding water and acid catalyst to tetra-alkyl silicate for hydrolysis and dehydropolycondensation is made to progress or a polymer obtained by commercial alkyl silicate solution which has been already polymerized to tetramer to pentamer is further subjected to hydrolysis and dehydropolycondensation and the like may be used.

If the dehydropolycondensation has progressed too much, solution viscosity is raised and solidified in the end, and a degree of dehydropolycondensation is adjusted to an upper limit viscosity or less that can be applied on a transparent substrate. However, the degree of dehydropolycondensation is not particularly limited as long as it is a level not more than the above upper-limit viscosity, but considering film strength, weather resistance and the like, approximately 500 to 50000 in a weight-average molecular weight is preferable. Then, the alkyl silicate hydrolyzed polymer (silica sol) substantially completes dehydropolycondensation reaction (cross-linking reaction) at heating after applying and drying of the transparent conductive layer forming coating liquid and becomes a hard silicate binder matrix (binder matrix mainly composed of silicon oxide). The dehydropolycondensation reaction starts immediately after drying of the film and as time elapses, the reaction solidifies the conductive oxide particles together firmly enough to an extent that they can not move, and if the inorganic binder is used, the above-mentioned compression processing needs to be conducted as soon as possible after applying and drying of the transparent conductive layer forming coating liquid.

As the binder, an organic-inorganic hybrid binder may be used. For example, such binders include a binder obtained by modifying the above-mentioned silica sol with partially organic functional group and a binder mainly composed of various coupling agents such as a silane coupling agent and the like.

The transparent conductive layer using the above inorganic binder or the organic-inorganic hybrid binder inevitably has an excellent solvent resistance but it should be selected as appropriate so that adhesion with the transparent coating layer and flexibility of the transparent conductive layer and the like are not deteriorated.

A ratio between the conductive oxide particles and the binder component in the transparent conductive layer forming coating liquid is, supposing that specific gravities of the conductive oxide particles and the binder components are approximately 7.2 (specific gravity of ITO) and approximately 1.2 (specific gravity of usual organic resin binder), respectively, in a weight ratio, is such that the conducive oxide particle: binder component=85:15 to 97:3, or preferably 87:13 to 95:5. The reason is that in the case of the rolling processing of the present invention, if the binder component is larger than 85:15, resistance of the transparent conductive layer becomes too high, while if the binder component is smaller than 97:3 on the contrary, strength of the transparent conductive layer is lowered and sufficient adhesion with the transparent coating layer can not be obtained.

The transparent coating layer forming coating liquid used in the present invention can be obtained by dissolving the above-mentioned transparent resin (binder component of the transparent coating layer) in a solvent.

In the case of the transparent coating layer forming coating liquid containing fiber and/or flake particles, the liquid can be obtained by dispersing the fiber and/or flake particles, for which adhesion-promoting treatment (coupling agent treatment, plasma treatment and the like) is applied on the surface as necessary, in a solvent containing a transparent resin. In this case, various coupling agents such as a silane coupling agent and the like, various polymer dispersing agents, various surfactants such as anionic, nonionic, cationic and the like may be used as the dispersing agent as necessary. These dispersing agents can be selected as appropriate according to a type of the fiber and/or flake particles in use and the dispersing processing method. As the dispersing processing, general-purpose methods such as ultrasonic processing, homogenizer, paint shaker, beads mill and the like may be applied. Concentrations of the transparent resin and the fiber and/or flake particles may be set as appropriate according to an application method in use. A mixing ratio between the transparent resin and the fiber and/or flake particles may be such that, though it depends on the material to be used, a mixed amount of the fiber and/or flake particles to the total of the transparent resin and the fiber and/or flake particles is 5 to 60 volume %, or more preferably 10 to 30 volume %. If it is less than 5 volume %, the effect of reinforcement by the fiber and/or flake particles is not found, while if it exceeds 60 volume %, there are too many fiber and/or flake particles, which makes the transparent coating layer porous and lowers the strength, and at the same time, a surface roughness of the transparent coating layer is increased and it becomes difficult to uniformly form the transparent conductive layer on it.

The method for manufacturing the transparent conductive layer forming coating liquid used in the present invention will be described. First, after the conductive oxide particles are mixed with a solvent and a dispersing agent as necessary, dispersing processing is applied so as to obtain a liquid with conductive oxide particles dispersed. As the dispersing agent, various coupling agents such as a silane coupling agent and the like, various polymer dispersing agents, various surfactants such as anionic, nonionic, cationic and the like can be cited. These dispersing agents can be selected as appropriate according to the type of the conductive oxide particle in use and dispersing processing method applied. Alternatively, even if no dispersing agent is used at all, depending on a combination of the conductive oxide particle and the solvent to be applied and the dispersing method, a favorable dispersing state can be obtained in some cases. Since the use of the dispersing agent might deteriorate the resistance value of the film or weather resistance, the transparent conductive layer forming coating liquid without using the dispersing agent is the most preferable. As the dispersing processing, general-purpose methods such as ultrasonic processing, homogenizer, paint shaker, beads mill and the like may be applied.

By adding the binder component to the obtained liquid with conductive oxide particles dispersed, and moreover, by applying component adjustment of the conductive oxide particle concentration, solvent composition and the like, the transparent conductive layer forming coating liquid is obtained. Here, the binder component is added to the liquid with the conductive oxide particles dispersed, but it may be added in advance before the dispersing process of the conductive oxide particles and there is no particular restriction. The conductive oxide particle concentration may be set as appropriate according to the application method (coating method) to be used.

A solvent used for the transparent conductive layer forming coating liquid is not particularly limited but may be selected as appropriate depending on the application method (coating method), film forming conditions, and a material of the transparent coating layer. For example, they include water, alcohol solvents such as methanol (MA), ethanol (EA), 1-propanol (NPA), isopropanol (IPA), butanol, pentanol, benzyl alcohol, diacetone alcohol (DAA) and the like, ketone solvents such as acetone, methyl ethyl ketone (MEK), methyl propyl ketone, methyl isobutyl ketone (MIBK), cyclohexanone, isophorone and the like, ester solvents such as ethyl acetate, butyl acetate, methyl lactate and the like, glycol derivatives such as ethylene glycol monomethyl ether (MCS), ethylene glycol monomethyl ether (ECS), ethylene glycol isopropyl ether (IPC), ethylene glycol monobutyl ether (BCS), ethylene glycol monoethyl ether acetate, ethylene glycol monobutyl ether acetate, propylene glycol monomethyl ether (PGM), propylene glycol ethyl ether (PE), propylene glycol methyl ether acetate (PGM-AC), propylene glycol ethyl ether acetate (PE-AC), diethylene glycol monomethyl ether, diethylene glycol monoethyl ether, diethylene glycol monobutyl ether, diethylene glycol monomethyl ether acetate, diethylene glycol monoethyl ether acetate, diethylene glycol monobutyl ether acetate, diethylene glycol dimethyl ether, diethylene glycol diethyl ether, diethylene glycol dibutyl ether, dipropylene glycol monomethyl ether, dipropylene glycol monoethyl ether, dipropylene glycol monobutyl ether and the like, benzene derivatives such as toluene, xylene, mesitylene, dodecyl benzene and the like, formamide (FA), N-methyl formamide, dimethyl formamide (DMF), dimethyl acetamide, dimethyl sulfoxide (DMSO), N-methyl-2-pyrolidone (NMP), γ-butyrolactone, ethylene glocol, diethylene glycol, tetrahydrofuran (THF), chloroform, mineral spirits, terpineol and the like, but not limited to them.

Next, a method for manufacturing the dispersion-type electroluminescent element according to the present invention will be described.

First, using the transparent coating layer forming coating liquid containing the resin binder (transparent resin) and the solvent, and moreover the visible-light transmissive fiber and/or flake particles as necessary, the transparent coating layer is formed by applying, drying, and curing it on a base film by a application method such as screen printing, blade coating, wire-bar coating, spray coating, roll coating, gravure printing and the like. Here, prior to the formation of the transparent coating layer, as necessary, using the transparent conductive layer forming coating liquid in which the conductive oxide particles are dispersed in a solvent containing a binder component, a second transparent conductive layer may be formed on the base film in advance by applying and drying and then, curing with a method similar to the above or curing is carried out after the compression processing to the second applied layer formed by applying and drying. Since the resistance value of the second transparent conductive layer may be a relatively high value as mentioned above, the rolling processing does not necessarily have to be carried out, and in that case, though the resistance value becomes worse (or increases), the transparent conductive layer forming coating liquid with more binder components than the above-mentioned mixing ratio of the conductive oxide particles and the binder component with the purpose of improving the film strength and adhesion.

Next, using the transparent conductive layer forming coating liquid, an applied layer is formed by applying and drying on the transparent coating layer with the method similar to the above and then, the above-mentioned compression processing is carried out. The compression processing is preferably carried out by the rolling processing of the metal rolls. After that, the rolling-processed applied layer is applied with curing processing such as drying curing, heat curing, ultraviolet curing and the like according to the type of the coating liquid so as to become a transparent conductive layer.

The term "applied layer" in the present description is used with a meaning of a film obtained by applying and drying the transparent conductive layer forming coating liquid, and the term "transparent conductive layer" is used with a meaning of a film finally obtained by using the transparent conductive layer forming coating liquid. Therefore, the "transparent conductive layer" is used clearly separately from the "applied layer" of the transparent conductive layer forming coating liquid.

The phosphor layer, the dielectric layer, and the rear electrode layer formed on the transparent conductive layer can be formed sequentially by the screen printing and the like. As a paste for applying (printing) and forming each layer of the phosphor layer, the dielectric layer, and the rear electrode layer, a commercially available paste can be used. The phosphor layer paste and the dielectric layer paste are obtained by dispersing phosphor particles and dielectric particles in a solvent containing a binder mainly composed of a fluorine rubber, respectively, and the rear electrode layer paste is obtained by dispersing conductive particles such as carbon particles and the like in a solvent containing a thermosetting resin binder.

Here, if each layer such as the phosphor layer and the like is screen-printed on the transparent conductive layer, a suction stage with a large number of small-diameter holes is used in general, and a method of fixing the film by reducing the pressure of the hole portion is used. If the base film is thin, the film on the hole portion is deformed and hollowed due to pressure reduction, which causes a problem of a trace of this hollow on the screen-printed film, but in the present invention, as mentioned above, a base film having a sufficient strength is used at the screen printing, and it is peeled off and removed after the dispersion-type EL element is formed, and the problem can be prevented.

The base film used in the present invention is preferably applied with heating processing (thermal shrinkage processing) in advance at 130 to 150° C., which is a thermal processing temperature of the manufacturing process of the dispersion-type EL element, in order to prevent shrinkage (dimensional change) by the heating processing in the manufacturing process of the dispersion-type EL element and curling of the film. If the thermoplastic resin, thermosetting resin are used for the transparent resin of the transparent coating layer forming coating liquid, the heating processing (thermal shrinkage processing) can be omitted if the heating processing temperature can be set to 120 to 150° C. in the drying curing or heat curing after the transparent coating layer forming coating liquid is applied on the base film.

Major portions of the dispersion-type EL element are constituted by the above transparent conductive layer, the phosphor layer, the dielectric layer, and the rear electrode layer, but in the actual dispersion-type EL element, a collecting electrode (formed by silver paste) of the transparent conductive layer, a lead electrode (formed by silver paste) of the rear electrode layer, insulating protective coating (formed by insulating paste) for preventing short-circuit between electrodes, electric shock and the like are further formed.

The dispersion-type electro luminescent element of the present invention is excellent in flexibility as a dispersion-type EL element since the thickness of the transparent coating layer is thin and flexible, and the element is applied as a light emitting element to be incorporated in a key input component of a device and enables obtainment of a favorable click feeling of a key operation without any special structure or devising of the key pad. Therefore, the element can be applied as a light emitting element to be incorporated in the key input component of a device such as a cellular phone, a remote controller, a portable information terminal and the like.

EXAMPLE

Examples of the present invention will be specifically described below, but the present invention is not limited to the examples. Also, the "%" in the text indicates "weight %" except for "%" of transmittance and haze value and a "part" indicates a "part by weight".

Example 1

Granular ITO particles with an average particle size of 0.03 μm (product name: SUFP-HX, by Sumitomo Metal Mining Co., Ltd.) in 36 g, methyl isobutyl ketone (MIBK) as a solvent in 24 g, and cyclohexanone as a solvent in 36 g are mixed and applied with dispersing processing and then, urethane acrylate ultraviolet-curable resin binder in 3.8 g and a photoinitiator (Darocur 1173) in 0.2 g are added and agitated well so as to obtain a transparent conductive layer forming coating liquid in which the ITO particles with an average dispersed particle size of 130 nm are dispersed (liquid A).

On a PET film (by Teijin Limited, thickness of 100 μm) as a base film without adhesion-promoting treatment, a urethane resin solution (by Adeka Corporation, ADEKA BONTIGHTER HUX-840) as a transparent coating layer forming coating liquid is wire-bar coated (wire diameter: 0.4 mm) and cured at 40° C.×10 minutes −120° C.×60 minutes so as to obtain the transparent coating layer (film thickness: 10 μm) made from a urethane resin. On this transparent coating layer, the transparent conductive layer forming coating liquid (liquid A) is wire-bar coated (wire diameter: 0.15 mm) and dried at 60° C. for 1 minute and then, the rolling processing by hard-chromium-plated steel rolls with a diameter of 100 mm (linear pressure: 200 kgf/cm=196 N/mm, nip width: 0.9 mm) is carried out, and the binder component is further cured (in nitrogen, 100 mW/cm$^2$×2 seconds) by a high-pressure mercury lamp so as to form the transparent conductive layer (film thickness: 1.0 μm) constituted by the ITO particles closely packed and the binder on the transparent coating layer and a laminate film made of base film/transparent coating layer/transparent conductive layer is obtained. The packing density of the conductive particles in the transparent conductive layer after the rolling processing is approximately 57 vol %.

Since the transparent coating layer is thin as 10 μm and the urethane resin has high transparency, visible-light absorption caused by provision of the transparent coating layer can be ignored (transmittance of the transparent coating layer=100%).

The film characteristics of the transparent conductive layer are visible-light transmittance: 90.0%, haze value: 2.8%, surface resistivity: 645Ω/□. Since the surface resistivity is subjected to influence of ultraviolet irradiation at the binder curing and tends to lower temporarily immediately after the curing, measurement is made one day after the formation of the transparent conductive layer.

The transmittance and the haze value of the above-mentioned transparent conductive layer are the values only of the transparent conductive layer and acquired by the following calculation formulas 1 and 2, respectively:

Transmittance of the transparent conductive layer(%)= [(transmittance measured for the base film on which the transparent conductive layer and the transparent coating layer are formed)/transmittance of the base film on which the transparent coating layer is formed]×100 [Calculation Formula 1]

Haze value of the transparent conductive layer(%)= (haze value measured for the base film on which the transparent conductive layer and the transparent coating layer are formed)−(haze value of the base film on which the transparent coating layer is formed) [Calculation Formula 2]

However, the transmittance and the haze value of the base film on which the transparent coating layer is formed are substantially equal to the transmittance and the haze value of the base film (that is, the transmittance of the transparent coating layer=approximately 100%, haze value of the transparent coating layer=approximately 0%).

The surface resistivity of the transparent conductive layer is measured by using a surface resistivity meter Loresta-AP (MCP-T400) by Mitsubishi Chemical Corporation. The haze value and the visible-light transmittance are measured by using a haze meter (HR-200) by Murakami Color Research laboratory Co., Ltd.

Next, on the transparent conductive layer of the laminate film, a phosphor paste (by Dupont, 7154J) in which zinc sulfide particles, which are phosphor, are dispersed in a resin solution mainly composed of fluorine polymer is made, screen printing with a size of 4×5 cm using a 200-mesh polyester screen is applied, and it is dried at 120° C.×30 minutes so as to form the phosphor layer.

On the above phosphor layer, a dielectric paste (by Dupont, 7153) in which barium titanate particles are dispersed in a resin solution mainly made of fluorine polymer is prepared, screen printing with a size of 4×5 cm using a 200-mesh polyester screen is applied, and it is dried (120° C.×30 minutes), such a screen printing step and drying step are repeated twice so as to form the dielectric layer.

On the dielectric layer, a carbon conductive paste (by Fujikura Kasei Co., Ltd., FEC-198) is screen-printed with a size of 3.5×4.5 cm using a 200-mesh polyester screen, and it is dried at 130° C.×30 minutes so as to form a rear electrode layer.

On one ends of the transparent conductive layer and the rear electrode layer, an Ag lead for voltage application is formed using a silver conductive paste so as to have a dispersion-type EL element according to Example 1 (base film/transparent coating layer/transparent conductive layer/phosphor layer/dielectric layer/rear electrode layer). In order to prevent short-circuit between electrodes, electric shock and the like, as insulating protective coating of the transparent conductive layer and the rear electrode layer, an insulating layer is formed using an insulating paste (by Fujikura Kasei Co., Ltd., XB-101G) as necessary, but since it is not a portion relating to the essentials of the present invention, the details are omitted.

In the above dispersion-type EL element, the base film can be easily peeled off at the interface with the transparent coating layer. When a voltage of 100V, 400 Hz is applied to between the leads for voltage application of the dispersion-type EL element obtained by peeling off the base film, the dispersion-type EL element uniformly emits light and its brightness measurement shows 53 Cd/m$^2$. The brightness is measured by a brightness meter (by Topcon Corporation, product name: BM-9).

Example 2

In Example 1, the transparent conductive layer forming coating liquid (liquid A) is wire-bar coated (wire diameter: 0.075 mm) so as to form the transparent conductive layer (film thickness: 0.5 μm) composed of ITO particles closely packed and the binder on the transparent coating layer and a laminate film constituted by base film/transparent coating layer/transparent conductive layer is obtained. The packing density of the conductive particles in the transparent conductive layer after the rolling processing is approximately 57 vol %.

Similarly to Example 1 except that the transparent conductive layer having visible-light transmittance: 95.5%, haze value: 2.3%, surface resistivity: 1450Ω/□ is obtained, the dispersion-type EL element according to Example 2 is obtained.

In the above dispersion-type EL element, the base film can be easily peeled off at the interface with the transparent coating layer. When a voltage of 100V, 400 Hz is applied to between the leads for voltage application of the dispersion-type EL element obtained by peeling off the base film, the dispersion-type EL element uniformly emits light and its brightness measurement shows 50 Cd/m$^2$.

Example 3

Granular ITO particles with an average particle size of 0.03 μm (product name: SUFP-HX, by Sumitomo Metal Mining Co., Ltd.) in 36 g, methyl isobutyl ketone (MIBK) as a solvent in 24 g, and cyclohexanone in 36 g are mixed and applied with dispersing processing and then, urethane acrylate ultraviolet-curable resin binder that has some adhesion but can be peeled off a PET film in 3.8 g and a photoinitiator (Darocur 1173) in 0.2 g are added and agitated well so as to obtain a transparent conductive layer forming coating liquid in which the ITO particles with an average dispersed particle size of 130 nm are dispersed (liquid B).

On a PET film (by Teijin Limited, thickness of 100 μm) as a base film without adhesion-promoting treatment, the transparent conductive layer forming coating liquid (liquid B) is wire-bar coated (wire diameter: 0.075 mm) and dried at 60° C. for 1 minute and then, the rolling processing (linear pressure: 200 kgf/cm=196 N/mm, nip width: 0.9 mm) is carried out similarly to Example 1, and the binder component is further cured (in nitrogen, 100 mW/cm$^2$×2 seconds) by a high-pressure mercury lamp so as to form the second transparent conductive layer (film thickness: 0.4 μm) constituted by the ITO particles and the binder. The second transparent conductive layer has visible-light transmittance: 95.0%, haze value: 2.5%, surface resistivity: 2500Ω/□. Using the same procedure as that of Example 1 except that the transparent coating layer is formed on the second transparent conductive layer, a transparent conductive layer (film thickness: 1.0 μm) constituted by the ITO particles closely packed and the binder on the transparent coating layer is formed, and a laminate film constituted by base film/second transparent conductive layer/transparent coating layer/transparent conductive layer is obtained. The packing density of the conductive particles in the transparent conductive layer after the rolling processing is approximately 57 vol %.

Similarly to Example 1 except that the transparent conductive layer having visible-light transmittance: 90.2%, haze value: 2.8%, surface resistivity: 670Ω/□ is obtained, the dispersion-type EL element according to Example 3 is obtained.

The transmittance and the haze value of the above-mentioned transparent conductive layer are the values only of the transparent conductive layer and acquired by the following calculation formulas 3 and 4, respectively:

Transmittance of the transparent conductive layer(%)= [(transmittance measured for the base film on which the transparent conductive layer, the transparent coating layer, and the second transparent conductive layer are formed)/transmittance of the base film on which the transparent coating layer and the second transparent conductive layer are formed]×100 [Calculation Formula 3]

Haze value of the transparent conductive layer(%)= (haze value measured for the base film on which the transparent conductive layer, the transparent coating layer, and the second transparent conductive layer are formed)−(haze value of the base film on which the transparent coating layer and the second transparent conductive layer are formed) [Calculation Formula 4]

In the above dispersion-type EL element, the base film can be easily peeled off at the interface with the second transparent conductive layer. When a voltage of 100V, 400 Hz is applied to between the leads for voltage application of the dispersion-type EL element obtained by peeling off the base film, the dispersion-type EL element uniformly emits light and its brightness measurement shows 51 Cd/m$^2$.

Example 4

Urethane acrylate ultraviolet-curable resin (by Negami Chemical Industrial Co., Ltd., Art Resin H-14 [developed product]) as a transparent resin in 38 g and a photoinitiator (Darocur 1173) in 2 g are mixed with methyl isobutyl ketone (MIBK) in 60 g so as to obtain a transparent coating layer forming coating liquid (liquid C).

On a PET film (by Teijin Limited, thickness of 100 μm) as a base film without adhesion-promoting treatment, the transparent coating layer forming coating liquid (liquid C) is wire-bar coated (wire diameter: 0.5 mm) and dried at 60° C.×5 minutes and then, applied with ultraviolet curing (by a high-pressure mercury lamp, 100 mW/cm$^2$×4 seconds) so as to obtain the transparent coating layer (film thickness: approximately 12 μm) constituted by the acrylic urethane resin. The base film on which the transparent coating layer is formed has a transparent appearance and has film characteristics of visible-light transmittance: 90.2% and haze value: 2.0% (transmittance of the transparent coating layer=substantially 100%).

Using the same procedure as that of Example 1 except that the transparent conductive layer is formed on the transparent coating layer, a transparent conductive layer (film thickness: approximately 1.0 μm) constituted by the ITO particles closely packed and the binder is formed, and a laminate film constituted by base film/transparent coating layer/transparent conductive layer is obtained. The packing density of the conductive particles in the transparent conductive layer is approximately 55 vol %.

In the above laminate film, the transparent coating layer having the transparent conductive layer can be easily peeled off at the interface with the base film.

The above base film is applied with heating processing in advance at 150° C.×10 minutes and then, the transparent coating layer is formed on it in order to prevent shrinkage (dimensional change) by the heating processing in the manufacturing process of the dispersion-type EL element and curling of the film.

The film characteristics of the transparent conductive layer are visible-light transmittance: 90.5%, haze value: 2.7%, surface resistivity: 590Ω/□. Since the surface resistivity is subjected to influence of ultraviolet irradiation at the binder curing and tends to lower temporarily immediately after the curing, measurement is made one day after the formation of the transparent conductive layer.

Using the same procedure as that of Example 1 except that the base film on which the above transparent conductive layer is formed is used, the dispersion-type EL element according to Example 4 is obtained.

In the above dispersion-type EL element, the base film can be easily peeled off at the interface with the transparent coating layer. When a voltage of 100V, 400 Hz is applied to between the leads for voltage application of the dispersion-type EL element obtained by peeling off the base film, the dispersion-type EL element uniformly emits light and its brightness measurement shows 53 Cd/m$^2$.

Example 5

Potassium titanate fiber [$K_2O$ $6TiO_2$] surface-treated by a silane coupling agent (γ-methacryloxypropyltrimethoxysilane) with a length of 10 to 20 μm and a thickness of 0.3 to 0.6 μm (by Otsuka Chemical Co., Ltd., TISMO N, true specific gravity=3.5 to 3.6) in 15 g and a polymer dispersing agent in 0.15 g are mixed with methyl isobutyl ketone (MIBK) as a solvent in 50 g and applied with the dispersing processing and then, the urethane acrylate ultraviolet-curable resin (by Negami Chemical Industrial Co., Ltd., Art Resin H-14 [developed product]) in 33.1 g and a photo initiator (Darocur 1173) in 1.75 g are added and agitated well so as to obtain a transparent coating layer forming coating liquid in which the potassium titanate fibers are dispersed in the solvent containing the transparent resin (liquid D). The mixed amount of the fibers in the transparent coating layer forming coating liquid is, when calculated with the specific gravity of the transparent resin (including photoinitiator) supposed to be at approximately 1.2, 12.6 vol %.

On a PET film (by Teijin Limited, thickness of 100 μm) as a base film without adhesion-promoting treatment, the transparent coating layer forming coating liquid (liquid D) is wire-bar coated (wire diameter: 0.5 mm) and dried at 60° C.×5 minutes and then, applied with ultraviolet curing (by a high-pressure mercury lamp, 100 mW/cm$^2$×4 seconds) so as to obtain the transparent coating layer (film thickness: approximately 12 μm) constituted by the acrylic urethane resin reinforced by the potassium titanate fibers. The base film on which the transparent coating layer is formed has a appearance of white coating film and has film characteristics of visible-light transmittance: 40.8% and haze value: 90.8% (absorption of visible light is small but since scattering is extremely large, apparently measured transmittance is low).

Using the same procedure as that of Example 1 except that the transparent conductive layer is formed on the transparent coating layer, a transparent conductive layer (film thickness: approximately 1.0 μm) constituted by the ITO particles closely packed and the binder is formed, and a laminate film constituted by base film/transparent coating layer reinforced by fiber/transparent conductive layer is obtained. The packing density of the conductive particles in the transparent conductive layer after the rolling processing is approximately 55 vol %. In the above laminate film, the transparent coating layer reinforced by the fibers having the transparent conductive layer can be easily peeled off at the interface with the base film.

The above base film is applied with heating processing in advance at 150° C.×10 minutes and then, the transparent coating layer is formed on it in order to prevent shrinkage (dimensional change) by the heating processing in the manufacturing process of the dispersion-type EL element, which will be described later, and curling of the film.

The film characteristics of the transparent conductive layer are visible-light transmittance: 87.7%, haze value: 1.2%, surface resistivity: 610Ω/□. Since the surface resistivity is subjected to influence of ultraviolet irradiation at the binder curing and tends to lower temporarily immediately after the curing, measurement is made one day after the formation of the transparent conductive layer.

The transmittance and the haze value of the above transparent conductive layer are obtained by the calculation formulas 1 and 2 of Example 1, but as mentioned above, the base film on which the transparent coating layer reinforced by the fiber is formed has translucency but its transparency is not so good with the visible-light transmittance: 40.8% and haze value: 90.8%. Thus, an error in a value calculated by the above calculation formulas might be large.

Using the same procedure as that of Example 1 except that the base film on which the above transparent conductive layer is formed is used, the dispersion-type EL element according to Example 5 (base film/transparent coating layer reinforced by fiber/transparent conductive layer/phosphor layer/dielectric layer/rear electrode layer) is obtained.

In the above dispersion-type EL element, the base film can be easily peeled off at the interface with the transparent coating layer reinforced by fiber. When a voltage of 100V, 400 Hz is applied to between the leads for voltage application of the dispersion-type EL element obtained by peeling off the base film, the dispersion-type EL element uniformly emits light and its brightness measurement shows 49 Cd/m$^2$.

Example 6

On a PET film (by Teijin Limited, thickness of 100 μm) as a base film without adhesion-promoting treatment, the transparent conductive layer forming coating liquid (liquid B) used in Example 3 is wire-bar coated (wire diameter: 0.075 mm) and dried at 60° C. for 1 minute and then, the rolling processing (linear pressure: 200 kgf/cm=196 N/mm, nip width: 0.9 mm) is carried out similarly to Example 1, and the binder component is further cured (in nitrogen, 100 mW/cm$^2$×2 seconds) by a high-pressure mercury lamp so as to form the second transparent conductive layer (film thickness: approximately 0.4 μm) constituted by the ITO particles and the binder. The second transparent conductive layer has visible-light transmittance: 95.2%, haze value: 2.7%, surface resistivity: 2600Ω/□. Using the same procedure as that of Example 5 except that the transparent coating layer is formed on the second transparent conductive layer, a transparent conductive layer (film thickness: approximately 1.0 μm) constituted by the ITO particles closely packed and the binder on the transparent coating layer is formed, and a laminate film constituted by base film/second transparent conductive layer/transparent coating layer reinforced by fiber/transparent conductive layer is obtained. The packing density of the conductive particles in the transparent conductive layer after the rolling processing is approximately 54 vol %. In the above laminate film, the transparent coating layer reinforced by fiber having the second transparent conductive layer and the transparent conductive layer can be easily peeled off at the interface with the base film and the second transparent conductive layer.

The above base film is applied with heating processing in advance at 150° C.×10 minutes and then, the second transparent conductive layer is formed on it in order to prevent shrinkage (dimensional change) by the heating processing in the manufacturing process of the dispersion-type EL element and curling of the film.

The transparent conductive layer has visible-light transmittance: 87.5%, haze value: 1.5%, surface resistivity: 620Ω/□. The conditions except that the transparent conductive layer is obtained are similar to those of Example 1 so as to obtain the dispersion-type EL element according to Example 6.

The transmittance and the haze value of the above-mentioned transparent conductive layer are the values only of the transparent conductive layer and acquired by the calculation formulas 3 and 4 of Example 3, respectively.

In the above dispersion-type EL element, the base film can be easily peeled off at the interface with the second transparent conductive layer. When a voltage of 100V, 400 Hz is applied to between the leads for voltage application of the dispersion-type EL element obtained by peeling off the base film, the dispersion-type EL element uniformly emits light and its brightness measurement shows 47 Cd/m$^2$.

Comparative Example 1

In Example 1, in the process for forming the transparent conductive layer, the transparent conductive layer (film thickness: 1.3 μm) constituted by the ITO particles not packed closely and the binder on the PET film is formed without conducting the rolling processing (linear pressure: 200 kgf/cm=196 N/mm). The packing density of the conductive particles in this transparent conductive layer is approximately 44 vol %.

The film characteristics of the transparent conductive layer are visible-light transmittance: 84.9%, haze value: 15.3%, surface resistivity: 21 KΩ/□. Since the surface resistivity is subjected to influence of ultraviolet irradiation at the binder curing and tends to lower temporarily immediately after the curing, measurement is made one day after the formation of the transparent conductive layer.

With the process similar to Example 1 except that the base film on which the transparent conductive layer is formed is used, the dispersion-type EL element according to Comparative Example 1 is obtained.

In the above dispersion-type EL element, the base film can be easily peeled off at the interface with the transparent coating layer. When a voltage of 100V, 400 Hz is applied to between the leads for voltage application of the dispersion-type EL element obtained by peeling off the base film, the dispersion-type EL element non-uniformly emits light and has an extremely low brightness portion as approximately 30 Cd/m$^2$.

Comparative Example 2

In Example 1, using the same procedure as that of Example 1 except that the transparent coating layer is not formed and the PET film as a base film with a thickness of 100 μm applied with adhesion-promoting treatment by corona discharge treatment is used, the transparent conductive layer (film thickness: 1.0 μm) constituted by the ITO particles closely packed and the binder on the base film is formed. The packing density of the conductive particles in the transparent conductive layer after the rolling processing is approximately 60 vol %.

The transparent conductive layer has visible-light transmittance: 93.0%, haze value: 2.4%, surface resistivity: 545Ω/□. The rest is conducted similarly to Example 1, the dispersion-type EL element according to Comparative Example 2 (PET film/transparent conductive layer/phosphor layer/dielectric layer/rear electrode layer) is obtained.

When a voltage of 100V, 400 Hz is applied to between the leads for voltage application of the above dispersion-type EL element, the dispersion-type EL element uniformly emits light and its brightness measurement shows 53 Cd/m$^2$.

Comparative Example 3

In Comparative Example 2, similarly to Comparative Example 2 except that instead of the PET film having the transparent conductive layer constituted by the ITO particles closely packed and the binder, a commercially available sputtered ITO film (visible-light transmittance: 92.0%, haze value: 0%, surface resistivity: 100Ω/□) in which the ITO layer is formed on the PET film (base film) with the thickness of 125 μm by sputtering method is used, the dispersion-type EL element according to Comparative Example 3 (PET film/sputtered ITO layer/phosphor layer/dielectric layer/rear electrode layer) is obtained.

When a voltage of 100V, 400 Hz is applied to between the leads for voltage application of the above dispersion-type EL element, the dispersion-type EL element uniformly emits light and its brightness measurement shows 55 Cd/m$^2$.

The transmittance and the haze value of the above-mentioned sputtered ITO film are the values only of the ITO layer and acquired, respectively, by the following calculation formulas 5 and 6:

Transmittance of the ITO layer(%)=[(transmittance measured for the base film on which the ITO layer is formed)/transmittance of the base film]×100 [Calculation Formula 5]

Haze value of the ITO layer(%)=(haze value measured for the base film on which the ITO layer is formed)−(haze value of the base film) [Calculation Formula 6]

Comparative Example 4

In Example 1, the same procedure as that of Example 1 except that the transparent coating layer is not formed and the PET film as a base film with a thickness of 12 μm applied with adhesion-promoting treatment by corona discharge treatment is used, but since the thickness of the base film is small, wrinkles and distortion occur in the film in the rolling processing process, and the dispersion-type EL element can not be manufactured.

[Strength Evaluation of Transparent Coating Layer]

The transparent coating layer (the layer obtained by peeling off and removing the base film from the laminate film) having the transparent conductive layer obtained in each Example has a predetermined strength sufficient for practical use. Particularly, the transparent coating layer reinforced by fiber having the transparent conductive layer in Examples 5 and 6 has a rupture strength of approximately twice of that of the transparent coating layer not reinforced by the fiber having the transparent conductive layer in Example 4, and the effect of fiber reinforcement can be confirmed (the rupture strength is measured by making the transparent coating layer having the transparent conductive layer into a strip shape and conducting a tensile test on it.)

[Flexibility Evaluation of Dispersion-Type EL Element]

After the dispersion-type EL element (the element obtained by peeling off the base film) according to each Example and the dispersion-type EL element according to each Comparative Example are wound around a rod with a diameter of 3 mm once each so that their light emitting faces are faced inward and outward, respectively, a voltage of 100V, 400 Hz is applied to between the leads for voltage application of the dispersion-type EL element and a light emitting state of the element is observed. In each Example, no change is found in the light emitting state. With Comparative Example 2, partially because the thickness of the PET film as base material is as thick as 100 μm, it is difficult to wind it around the rod with the diameter of 3 mm, and when it is forced, a peeled-off portion is caused in a part of the element, which makes the light emission non-uniform. With Comparative Example 3, a crack is caused in the sputtered ITO layer, and almost no light is emitted from the element. Since Comparative Example 1 originally has non-uniform light emission, evaluation is not made.

[Solvent Resistance Evaluation of Transparent Conductive Layer]

In each Example, after the transparent conductive layer is formed on the transparent coating layer, the transparent conductive layer face is rubbed by a cotton swab dipped with acetone reciprocally ten times and the change in appearance is observed, but no change is found at all. The dispersion-type EL element is made using the evaluated transparent conductive layer and a voltage of 100V, 400 Hz is applied to between the leads for voltage application and the light emitting state of the element is observed, but light emission is uniform, including the portion rubbed by the cotton swab, and no influence by acetone is found.

What is claimed is:

1. A method for manufacturing a dispersion-type electroluminescent element in which at least a transparent coating layer, a transparent conductive layer, a phosphor layer, a dielectric layer, and a rear electrode layer are sequentially formed on a base film surface, characterized in that an applied layer is formed using a transparent conductive layer forming coating liquid mainly composed of conductive oxide particles and a binder on a surface of said transparent coating layer formed using a transparent coating layer forming coating liquid mainly composed of a transparent resin and then, compression processing is conducted for said base film on which the transparent coating layer and the applied layer are formed and then, the applied layer is cured so as to form the transparent conductive layer.

2. A method for manufacturing a dispersion-type electroluminescent element in which at least a transparent coating layer, a transparent conductive layer, a phosphor layer, a dielectric layer, and a rear electrode layer are sequentially formed on a base film surface, characterized in that a second transparent conductive layer is formed by applying and curing using a transparent conductive layer forming coating liquid mainly composed of the conductive oxide particles and the binder on said base film surface or by applying the compression processing to the second applied layer formed by application and then, curing the compressed layer, a transparent coating layer is applied and formed by using an a transparent coating layer forming coating liquid mainly composed of a transparent resin on a surface of the second transparent conductive layer and further, an applied layer is formed by using a transparent conductive layer forming coating liquid mainly composed of the conductive oxide particles and the binder on a surface of the transparent coating layer, and then, a transparent conductive layer is formed by applying the compression processing to the base film, the second transparent conductive layer, the transparent coating layer, and the applied layer and then, curing the applied layer.

3. The method for manufacturing a dispersion-type electroluminescent element according to claim 1, wherein said transparent coating layer forming coating liquid further contains visible-light transmissive fiber and/or flake particles.

4. A method for manufacturing a dispersion-type electroluminescent element, characterized in that the base film is further peeled off and removed from an interface with said the transparent coating layer or said second transparent conductive layer after the manufacturing process of the dispersion-type electroluminescent element according to claim 1.

5. The method for manufacturing a dispersion-type electroluminescent element according to claim 1, wherein said compression processing is carried out by rolling processing of metal rolls.

6. The method for manufacturing a dispersion-type electroluminescent element according to claim 5, wherein said rolling processing is carried out with a linear pressure: 29.4 to 784 N/mm (30 to 800 kgf/cm).

7. The method for manufacturing a dispersion-type electroluminescent element according to claim 5, wherein said rolling processing is carried out with a linear pressure: 98 to 490 N/mm (100 to 500 kgf/cm).

8. The method for manufacturing a dispersion-type electroluminescent element according to claim 2, wherein said transparent coating layer forming coating liquid further contains visible-light transmissive fiber and/or flake particles.

9. A method for manufacturing a dispersion-type electroluminescent element, characterized in that the base film is further peeled off and removed from an interface with said the transparent coating layer or said second transparent conductive layer after the manufacturing process of the dispersion-type electroluminescent element according to claim 2.

10. The method for manufacturing a dispersion-type electroluminescent element according to claim 2, wherein said compression processing is carried out by rolling processing of metal rolls.

11. The method for manufacturing a dispersion-type electroluminescent element according to claim 10, wherein said rolling processing is carried out with a linear pressure: 29.4 to 784 N/mm (30 to 800 kgf/cm).

12. The method for manufacturing a dispersion-type electroluminescent element according to claim 10, wherein said rolling processing is carried out with a linear pressure: 98 to 490 N/mm (100 to 500 kgf/cm).

* * * * *